United States Patent [19]

Mikulas

[11] 4,224,870

[45] Sep. 30, 1980

[54] SCREEN PRINTING MACHINE

[76] Inventor: Budai Mikulas, Pelikanstrasse 5, 9004 St. Gallen, Switzerland

[21] Appl. No.: 884,810

[22] Filed: Mar. 9, 1978

[30] Foreign Application Priority Data

Mar. 12, 1977 [DE] Fed. Rep. of Germany ..... 2710947

[51] Int. Cl.[2] ..... B41L 13/02

[52] U.S. Cl. ..... 101/123; 101/126; 118/213

[58] Field of Search ..... 118/213, 301; 101/116-123, 129

[56] References Cited

U.S. PATENT DOCUMENTS

| | | | |
|---|---|---|---|
| 2,340,643 | 2/1944 | Campbell | 101/129 |
| 2,881,698 | 4/1959 | Graham | 101/123 |
| 3,785,284 | 1/1974 | Vertegaal | 101/118 |

FOREIGN PATENT DOCUMENTS

| | | | |
|---|---|---|---|
| 192373 | 10/1957 | Austria | 101/121 |
| 548073 | 10/1922 | France | 101/122 |

*Primary Examiner*—Clyde I. Coughenour

*Attorney, Agent, or Firm*—Kenyon & Kenyon

[57] ABSTRACT

A screen printing machine for a web intermittently pulled forwardly to receive a succession of closely interspaced prints, has a printing table over which the web is intermittently pulled beneath a printing screen which contacts the web, and during each web stop a printing material knife is reciprocated over the screen to force printing material through the screen onto the web to make a print. A just-printed print can be pulled forwardly under the screen which to accommocate the deceleration and acceleration of its knife, extends forwardly beyond its printing area, so it is possible that still-wet print can be smudged by the screen contact. To prevent this, the printing table is provided with a slot down through which the web can pass so it does not contact the screen beyond the latter's printing area.

3 Claims, 3 Drawing Figures

SCREEN PRINTING MACHINE

BACKGROUND OF THE INVENTION

It is sometimes desirable to make a series of prints on a traveling web of material by the screen printing method, the web being necessarily intermittently pulled forwardly with the web stationary during each successive screen printing operation.

For example, the self-stick labels described by the Mikulas U.S. Pat. No. 4,009,065, Feb. 22, 1977, are manufactured in the form of a composite strip or web of label and protective layer materials, the web being continuously fed to an automatic punching machine which punches out the label contours while leaving the protective layer material partially punched but otherwise intact, that material being initially wider than the labels and, after punching, producing a lattice which at the punching machine, is peeled off and discarded as waste.

It is desirable to apply printing to each of the succession of labels and current demands require this printing to be done by the screen printing process which permits the application of greater printing layer thicknesses than is possible by offset or letter press printing, for example.

For screen printing a succession of closely interpositioned prints extending lengthwise on the web, the web can be intermittently pulled forwardly over a screen printing machine's printing table, the printing screen above the table being adapted to contact the web so that during each stop of the web, printing material, such as ink, can be forced through the screen by the usual knife reciprocating over the screen in the longitudinal direction of the web to spread the printing material and force it through the screen.

To obtain an acceptable production rate, the web must be pulled intermittently at an adequate rate, this requiring the knife to reciprocate rapidly. Therefore, due to the knife's stroke-end decelerating and accelerating requirements, the knife's overall reciprocating stroke length must be greater than the printing area where the printing action is desired.

The above introduced the problem that with the web intermittently pulled forwardly beneath the printing screen, a freshly made print just moved fowardly remains in contact with the screen pressed downwardly by the knife during its decelerating stroke end, thus possibly smudging or smearing the print if it remains wet at that time.

The above problem has existed for some time and various proposals have been made for solving the problem. For example, it has been proposed to lift the knife from the screen upon completion of its effective printing stroke, or to lift the screen including the knife, at that time. However, from the engineering viewpoint, such expedients are difficult to achieve and, in any event, involve high machine manufacture and maintenance costs.

SUMMARY OF THE INVENTION

According to the present invention, the printing table has a transverse slot down through which the web is intermittently pulled away from the printing table's top. This slot is positioned so that the printing screen extends forwardly beyond the slot and so that the forward reciprocating stroke limit of the knife extends forwardly beyond the slot. This permits the knife to extend beyond its effective printing stroke limit for deceleration and subsequent acceleration, without any possibility of the screen contacting the freshly printed web drawn downwardly through the slot. No engineering or expense complications are involved.

Preferably, the knife which must travel over the slot while decelerating and accelerating, is positioned at a slight angle of from 2° to 5° with respect to the slot which is itself positioned at right angles to the forwardly traveling web. This prevents the knife from forcing the screen into the slot or possibly acquiring a skipping motion.

Also preferably, keeping in mind that the printing table has thickness, the slot should have a forward angularity of from 25° to 35° with respect to the printing table's top plane, this effectively minimizing the frictional resistance involved as the web is pulled through the slot.

The web, when comprising the composite web described by the Mikulus patent, can be possibly damaged by extremely sharp bending; therefore, the running or top back edge of the printing table slot is preferably rounded off to provide a radius of from 5 to 8 mm. For the same reason, it may be advantageous to provide the top back edge of the slot with a roller having a radius of from 5 to 8 mm.

BRIEF DESCRIPTION OF THE DRAWINGS

The accompanying drawings schematically illustrate the principles of the invention, the various figures being as follows.

DETAILED DESCRIPTION OF THE INVENTION

Figure 1:
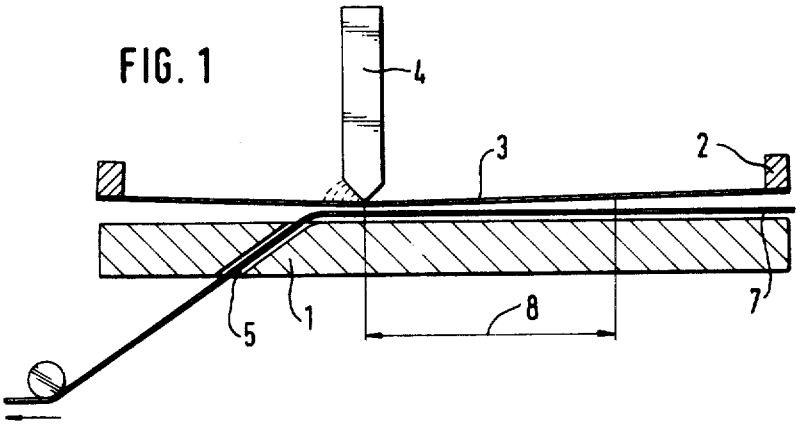
FIG. 1 is a longitudinal section of a machine embodying those principles.
Figure 2:
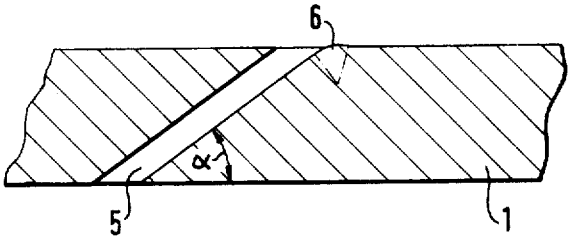
FIG. 2 is an enlargement of the slot described above.

Having reference to these drawings, the screen printing machine has a printing table 1 above which the printing screen frame 2 is positioned with its screen 3 stretched lengthwise over the table 1. The printing material knife 4 reciprocates forwardly and backwardly over the screen 3 so as to press the latter downwardly and force the printing material therethrough. The table 1 has the forwardly declining slot 5 with its back edge 6 rounded as shown by FIG. 2, the radius of the rounded surface being from 5 to 8 mm, while the angularity of the slot 5 ranges from 25° to 35° forwardly with respect to the plane of the top of the table 1.

The web 7 is intermittently pulled over the top of the table 1, the web halting or momentarily stopping in the area shown at 8 where the screen 3 above carries the pattern to be printed or printing area, the knife 4 through its reciprocation spreading the printing material through that area for printing on the web 1. As previously described, the screen 3 and the forward stroke limit of the knife 4 extend forwardly beyond or ahead of the slot 5 to provide for deceleration and subsequently acceleration of the knife 4, the distance the knife travels beyond its effective printing movement depending on the knife weight, the weight of its appropriate mechanism and the stroke velocity involved.

Figure 3:
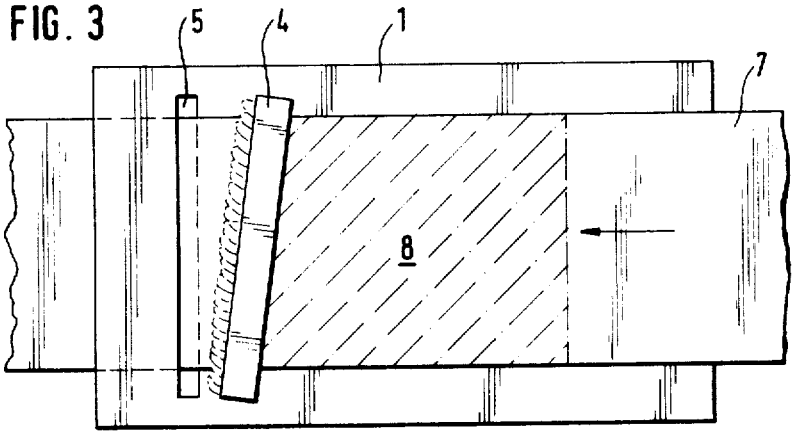
FIG. 3 is a top view looking down on the FIG. 1 illustration.

As shown by FIG. 3, the knife 4 is slightly positioned diagonally with respect to the screen 3 and, therefore, the entrance of the slot 5, the latter extending at right angles to the web travel. During its accelerating and decelerating phases, the knife 4 must travel over the slot 5, and this knife angularity prevents the knife from possibly pushing the screen down into the mouth of the slot.

What is claimed is:

1. A screen printing machine for a web intermittently pulled forwardly to receive a succession of closely interpositioned prints extending lengthwise on the web, said machine comprising a printing table having a flat top over which said web is intermittently pulled, a flat stationary printing screen above said table substantially parallel therewith and adapted to contact said web thereon, and a printing material knife reciprocating linearly over said screen in the longitudinal direction of said web and having an overall reciprocating stroke length that is greater than the printing area of said screen to permit the knife to decelerate and accelerate beyond its effective printing stroke when rapidly reciprocated, said table having a transverse slot which is at a right angle to said stroke and the length of said web and down through which said web is pulled away from the printing table's said top and said screen, said slot being positioned so that said screen extends forwardly beyond the slot and so that the forward overall reciprocating stroke limit of said knife extends forwardly beyond the slot and the web can by pulled forwardly free from smudging while said knife decelerates and accelerates beyond its effective printing stroke, said knife being positioned at an angle of from 2° to 5° with respect to said transverse slot so as to prevent the knife from pushing said screen downwardly into said slot.

2. The machine of claim 1 in which said slot has sides at an angle of from 25° to 35° with respect to the printing table's top, so that the slot angles forwardly and downwardly.

3. The machine of claims 1 or 2 in which said slot has a back top edge that is rounded so that said web slides smoothly thereover.

* * * * *